United States Patent [19]

Charbonneau

[11] Patent Number: 4,932,169

[45] Date of Patent: Jun. 12, 1990

[54] INFLATABLE STRUCTURE

[76] Inventor: Robert Charbonneau, 55 Rue St-Thomas,, Longueuil, Québec, Canada J4H 2Z4

[21] Appl. No.: 430,112

[22] Filed: Nov. 1, 1989

[51] Int. Cl.[5] ..... E04B 1/34; E04G 11/04; E04G 15/20; E04H 15/26

[52] U.S. Cl. ..... 52/2 H; 52/2 P; 135/99

[58] Field of Search ..... 52/2 E, 2 H, 2 P; 135/99

[56] References Cited

U.S. PATENT DOCUMENTS

| | | | |
|---|---|---|---|
| 3,035,590 | 5/1962 | Helmers | 52/2 N |
| 3,106,772 | 10/1963 | Holcombe | 52/2 L |
| 3,326,624 | 6/1967 | Maydell | 52/2 E |
| 4,099,351 | 7/1978 | Dalo | 52/2 P |
| 4,767,032 | 6/1987 | Jutras | 52/2 |

FOREIGN PATENT DOCUMENTS

| | | | |
|---|---|---|---|
| 2315616 | 3/1973 | Fed. Rep. of Germany | 52/2 H |
| 1282385 | 12/1961 | France | 52/2 H |
| 460186 | 10/1950 | Italy | 52/2 G |
| 575930 | 4/1958 | Italy | 52/2 P |
| 5021843 | 6/1985 | Japan | 52/2 H |
| 446603 | 10/1972 | U.S.S.R. | 52/2 K |
| 2115032 | 9/1983 | United Kingdom | 52/2 G |

OTHER PUBLICATIONS

"Pneumatic Structures" Gernot Minke & Hans Eggers, 1976 Verlag Gerd Hatje Stuttgart, pp. 22–27.

*Primary Examiner*—David A. Scherbel
*Assistant Examiner*—Deborah M. Ripley
*Attorney, Agent, or Firm*—Samuel Meerkreebs

[57] ABSTRACT

An inflatable structure comprises a double wall pneumatic envelope including top and bottom panels. The inflatable structure also includes a central mast and a series of peripheral poles. A central portion of the bottom panel is mounted to a top end of the mast, whereas the bottom end of the mast is secured to the ground. The poles are connected at their upper and lower ends respectively to peripheral portions of the envelope and to the ground. An unrestrained lens-shaped double wall envelope submitted therein with pneumatic pressure tends normally to undergo a reduction of its perimeter while its vertical thickens so as to adopt a sphere shape. Mere pneumatic pressure provided in the envelope thus causes the double wall envelope to inflate, the top panel being supported by the pneumatic pressure in an inflated position, whereas the peripheral portions of the envelope are supported, spaced apart from the ground, by the pneumatic pressure and by the poles. The peripheral poles prevent the envelope from adopting a sphere shape. Mechanical traction forces thus work along with pneumatic forces to provide a rigid and stable structure. Radially extending catenaries are provided in the top and bottom panels to provide further stability and rigidity to the structure. The catenaries at their outward ends are connected to the top ends of the poles, the inward ends of the catenaries of the lower panel being connected to the top end of the mast.

22 Claims, 4 Drawing Sheets

INFLATABLE STRUCTURE

BACKGROUND OF THE INVENTION

1. Field of the Invention

The present invention relates to inflatable dual wall structures and, more particularly, of the type utilized to form roof structures and other lightweight, large span, open structures.

2. Description of the Prior Art

Large span tent-like structures are widely used in flea markets, fairs, receptions, exhibitions and the like. Such applications necessitate a structure that is easily erected and taken down and that is economic and safe. Large canvas tents held in place by a series of masts and multi-directional poles are well known. On the other hand, the erection of such canvas tents is somewhat laborious.

Also known in the art are double wall inflatable structures made of lightweight fabric or synthetic material. These pneumatic structures generally include a complicated internal structure that can be made up of a plurality of intersecting rods or poles. Other inflatable pneumatic structures, such as the one disclosed in U.S. Pat. No. 4,676,032 (issued to Jutras on June 30, 1987) comprise a self-supporting inflatable structure including a polyhedron frame made from tension cables interconnected and joining at nodes with an envelope surrounding the frame. Anchoring skirts extend from each node line to predetermined lines on the panels forming the envelope. Under sufficient air pressure inside the envelope, the same produces an arch-shaped roof, wherein all of the tension cables are under tension and the overall structure becomes rigid, stable and capable of resisting deformation caused by various external forces applied thereto.

Although the above described inflatable structure yields excellent results, there is a need for an inflatable structure of different design and using generally different principles in order to obtain a structure of simple construction and requiring very few on-site steps for its erection.

SUMMARY OF THE INVENTION

It is therefore an aim of the present invention to provide an inflatable pneumatic structure of general simple construction.

It is also an aim of the present invention to provide an inflatable pneumatic structure including a dual wall envelope, wherein the internal structure ensuring the rigidity and stability of the envelope is of simple construction.

It is a still further aim of the present invention to provide an inflatable pneumatic structure which is simple to erect.

It is a still further aim of the present invention to provide an inflatable pneumatic structure which is very safe.

It is a still further aim of the present invention to provide an inflatable pneumatic structure that can be manufactured in various sizes and overall shapes.

A construction in accordance with the present invention comprises an inflatable structure comprising a double wall pneumatic envelope means including top and bottom panels. The inflatable structure further comprises a central mast and a series of peripheral stabilizer means A central portion of the bottom panel is adapted to be mounted to a top end part of the mast. A bottom end part of the mast is adapted for stable contact with a ground surface. The stabilizer means are adapted for connection at upper and lower ends thereof to peripheral portions of the envelope means and to the ground surface, respectively. Pneumatic pressure thus provided in the envelope means causes the double wall envelope means to inflate, the top panel being supported by the pneumatic pressure in an inflated position thereof. The peripheral portions of the envelope means are supported in a spaced apart relationship with respect to the ground surface by the pneumatic pressure and by the stabilizer means. This results in the envelope means assuming a tent-like structure.

In a further embodiment in accordance with the present invention, the envelope means of the inflatable structure further comprises a pneumatic peripheral belt having a C-shaped vertical cross-section. The top and bottom panels are separate panels having their peripheral edges adapted for connection in a spaced apart relationship respectively to upper and lower inner free edges of the peripheral belt. A convex portion of the belt extends outwards of the peripheral edges of the top and bottom panels, whereby the pneumatic pressure acts in the belt.

In a still further construction in accordance with the present invention, the top and bottom panels and the peripheral belt are each made of a flexible air impervious material. The top and bottom panels are made up of radially extending strips connected edge to edge with adjacent strips.

In a still further construction in accordance with the present invention, the top panel comprises a series of upper catenaries extending therein radially from a top portion thereof past the peripheral edge thereof and close to the convex portion of the peripheral belt. The bottom panel comprises a series of lower catenaries extending therein radially from an inner portion thereof past the peripheral edge thereof and close to the convex portion. Connection means are provided for connecting outward free ends of both the upper and lower catenaries to respective ones of the upper ends of the stabilizer means The lower catenaries have inward free ends adapted for connection to the top end part of the mast. The upper and lower catenaries thus allow the top and bottom panels respectively to extend under the pneumatic pressure in generally opposite directions in substantially uniform generally parabolic arch-shapes and further prevent the panels from over extending. The lower catenaries further provide support for the bottom panel when the envelope means is inflated.

In a still further construction in accordance with the present invention, a series of shrouds are provided each for connection at opposed free ends thereof to the top end part of the mast and to respective ones of the upper ends of the stabilizer means. The shrouds extend radially in the envelope means intermediate the top and bottom panels, whereby the shrouds provide stability to the envelope means when inflated.

In a still further construction in accordance with the present invention, the stabilizer means each comprise a pole adapted for connection at a lower end thereof to the ground surface and at an upper end thereof to the outward free ends of the upper and lower catenaries and of the shrouds. Guy cables may also be provided between the upper ends of the poles and the ground surface to enhance the stability thereof.

Due to the physical properties associated with pneumatic pressure, it is well known that a disk-shaped or lens-shaped double wall flexible envelope provided with pneumatic pressure therein will tend to contract at its perimeter and to vertically thicken at its center thereby adopting a sphere shape. The stabilizer means of the present invention each comprising a pole and a guy cable prevent the envelope from assuming such as sphere shape. To provide clearance under the inflatable structure, the central mast supports the central portion of the bottom panel forming the envelope. The bottom panel partially acts like a conventional tent whereby loss of air pressure in the inflated envelope only results in the top panel sagging on the bottom panel, the latter remaining spaced apart from the ground due to its connection to the rigid central mast and to the rigid poles.

In conventional tents, to prevent the canvas thereof from flapping under the action of strong winds, a complicated series of rigid elements such as tensioned cables and rods must be positioned throughout the tent structure for stretching the canvas. Such flapping of the canvas results in stresses which are applied to the rigid elements forming the structure. Collapsing of the structure is therefore possible due to these forces applied thereto. Fatigue of the rigid elements and of the canvas can also be encountered.

In the present invention, the envelope being inflated tends to contract at its horizontal diameter, that is the horizontal perimeter of the envelope tend to be reduced, thereby acting against the tensioned stabilizer means. Because of the pneumatic forces which act against the mechanical restraints of the stabilizer means, the inflated envelope is well stretched. This eliminates the flapping of the flexible top and bottom panels whereby no excessive stresses are applied thereon and on the rigid elements thereof.

The forces being distributed uniformly throughout the inflated structure, the top and bottom panels used can be relatively thinner and of a less rigid construction.

In summary, the present invention is totally unique in utilizing in a new application the mechanical traction forces together with pneumatic forces to form a rigid and stable structure.

BRIEF DESCRIPTION OF THE DRAWINGS

Having thus generally described the nature of the invention, reference will now be made to the accompanying drawings, showing by way of illustration a preferred embodiment thereof, and wherein.

DESCRIPTION OF THE PREFERRED EMBODIMENTS

Figure 1:
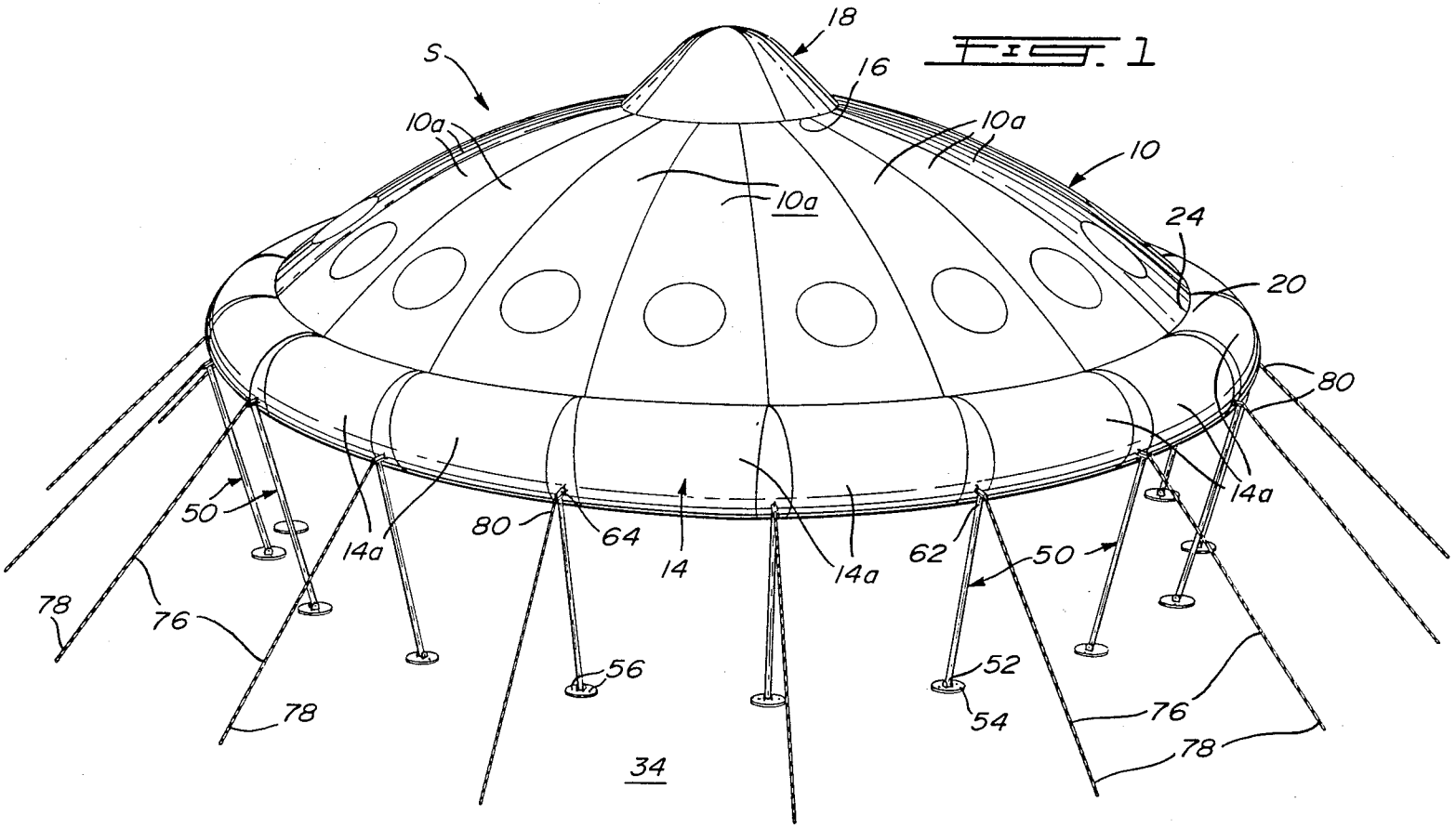
FIG. 1 is a perspective view showing an inflatable pneumatic structure in accordance with the present invention.
Figure 2:
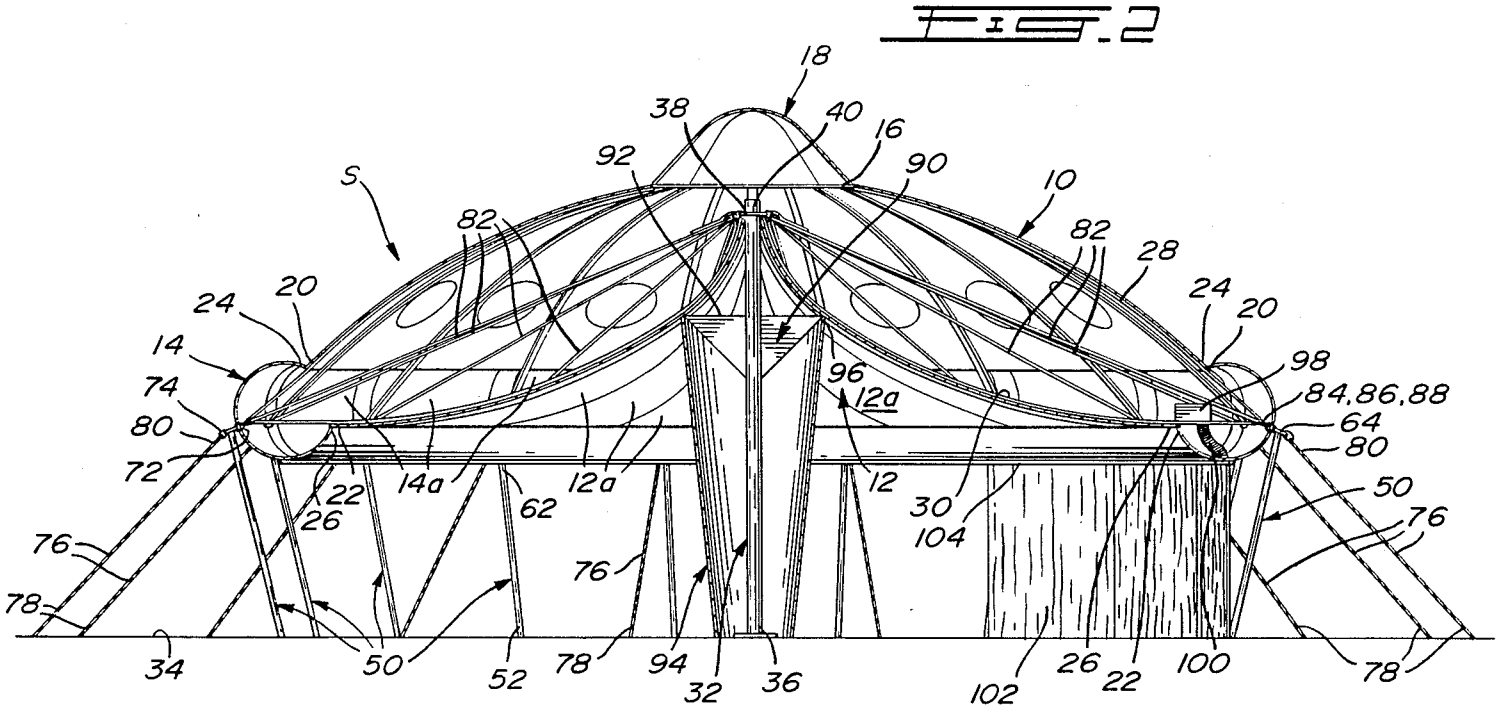
FIG. 2 is a vertical cross-sectional view of the inflatable structure of FIG. 1.

Now referring generally to FIGS. 1 and 2, an inflated pneumatic structure S in accordance with the present invention is herein illustrated. The inflated structure S has the form of a double wall envelope including top and bottom panels 10 and 12 respectively and a peripheral belt 14. The top and bottom panels 10 and 12 and the peripheral belt 14 are each made of a flexible air impervious material such as a polyester fabric having a PVC coating. The top and bottom panels 10 and 12 are each made up of radially extending strips indicated by **10*a* and 12*a* respectively connected with an overlap edge to edge with adjacent strips The strips 10*a* and 12*a*** can be joined one to the other by microwave welds or by seams.

In this preferred embodiment, in which the inflated structure S assumes in its inflated position the shape of a flying saucer, the top panel 10 has a substantially large opening defined therein at a central top portion 16 thereof A dome 18 which is made of strips of the same material as the top panel 10 is adapted to be mounted to the annular edge of the top panel 10 defining the aforementioned opening. The dome 18 can be permanently secured to the top panel 10 by microwave welds or by seams. Preferably, zippers are used to allow the dome 18 to be removably mounted to the top panel 10, whereby the dome 18 can be attached thereto at the site of erection of the inflatable structure S or at a site remote therefrom.

The peripheral belt 14 includes a series of sections **14*a* mounted end-to-end one to the other to form a polygonal outline having basically an annular shape. The sections 14*a* of the belt 14 have a general C-shaped vertical cross-section as shown in FIG. 2. The two annular free edges 20 and 22 of the belt 14 are respectively joined to the outward free edges 24 and 26 of the top and bottom panels 10 and 12 respectively. Similarly to the dome 18, the peripheral belt 14 can be joined permanently to the top and bottom panels 10 and 12 by microwave welds or by seams or, preferably, the belt 14** is detachably connected to the top and bottom panels by zippers.

At this point, it is easily seen that air provided in the inflated structure S will distribute under generally constant pressure between the top and bottom panels 10 and 12 and within the cavities defined by the peripheral belt 14 and by the dome 18. Under sufficient air pressure, the inflated structure S of this preferred embodiment will thus assume the position illustrated in FIGS. 1 and 2.

Upper catenaries 28 extend radially in said top panel 10 in a spaced apart relationship. These upper catenaries 28 issue from the annular edge defining the aforementioned opening on top of the top panel 10 and extend radially therefrom past the junction between the free edge 20 of the belt 14 and the outward free edge 24 of the top panel 10, as illustrated in FIG. 2. The upper catenaries 28 are preferably mounted between the overlapping edges of adjacent strips **10*a* forming the top panel 10**.

A series of lower catenaries 30 are similarly disposed in the bottom panel 12. The lower catenaries 30 in a way similar to the upper catenaries 28 extend past the junction between the free edge 22 of the peripheral belt 14 with the outward free edge 26 of the bottom panel 12. However, the lower catenaries 30 further extend inwardly past an opening defined centrally in the bottom panel 12 in order to connect these inward free edges to a central mast 32 which extends through the central opening of the bottom panel 12, as will be described in further details hereinafter.

Figure 3:
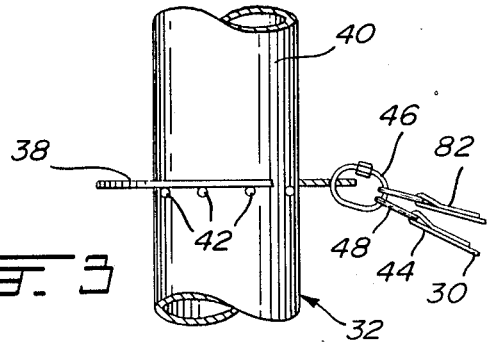
FIG. 3 is a cross-sectional elevation illustrating one mode of attachment of the catenaries and shrouds to the upper end of the central mast.

The mast 32 extends vertically from a ground 34 centrally of the inflated structure S. Suitable means may be used to secure a bottom end 36 of the mast 32 to the ground 34. As best seen in FIG. 3, an annular plate 38 is supported at a top end 40 of the mast 32 by a series of pins 42 extending radially around the top end 40. Openings are defined on the periphery of the annular plate 38 in order that each inward free end 44 of the lower catenaries 30 can be secured to the mast 32 by way of couplings such as the quick links 46 illustrated in FIG. 3. In this embodiment, a metal ring 48 secured to the inward free end 44 of the lower catenary 30 is engaged in the quick link 46 which passes through a respective one of the openings defined in the annular plate 38.

Figure 5:
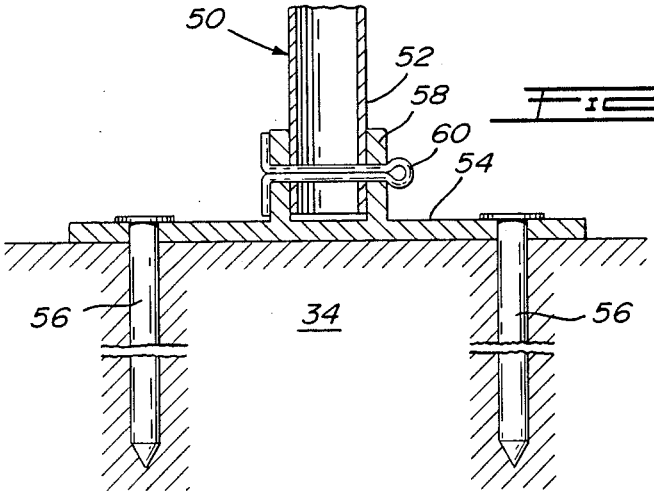
FIG. 5 is a cross-sectional elevation of a mode of attachment of the poles to the ground.

A series of poles 50 are disposed around the inflated structure S from the ground 34 to the peripheral belt 14 as seen in FIGS. 1 and 2. Now referring to FIG. 5, each pole 50 is maintained fixed at a lower end 52 thereof by a circular anchor plate 54 which is secured to the ground by nails 56 planted through openings defined therein into the ground 34. The anchor plate 54 has a short sleeve 58 extending upwards from a central portion thereof The lower end 52 of the pole 50 is fixed to the sleeve 58 by way of a pin 60 passing through diametrically opposed holes defined both in the lower end 52 of the pole 50 and in the sleeve 58 of the anchor plate 54.

Figure 4:
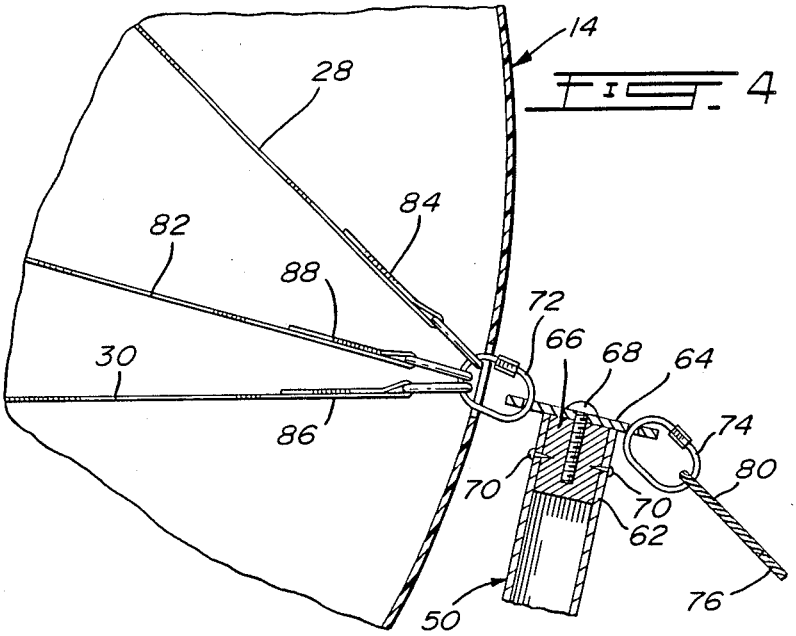
FIG. 4 a cross-sectional elevation showing a mode of attachment of the catenaries and shrouds to the peripheral poles and the attachment of a guy cable thereto.

Now referring to FIG. 4, an upper end 62 of the pole 50 includes a plate 64 secured thereto by way of a cylindrical piece of wood 66, a screw 68 and nails 70. The plate 64 has openings defined on opposed ends thereof for engagement with quick links 72 and 74. A guy cable 76 secured at a lower end 78 thereof to the ground 34 by way of a stake (not shown) is coupled to the quick link 74 at an upper end 80 thereof.

As best seen in FIGS. 2, 3 and 4, a series of shrouds 82 extend from the top end 40 of the mast 32 to the upper ends 62 of the poles 50. Referring to FIG. 3, the shroud 82 is coupled to the quick link 46 in a way identical to the inward free end 44 of the lower catenary 30.

Now referring to FIG. 4, outward free ends 84, 86 and 88 of the upper and lower catenaries 28 and 30 and of the shrouds 82 are all coupled in a similar way to the quick links 72 which extend through the peripheral belt 14 for engagement in one of the openings defined in the plate 64 of respective ones of the upper ends 62 of the poles 50.

The inflatable structure S further comprises a sealing envelope 90 which has the shape of a truncated cone and which includes an opening defined therethrough so that the sealing envelope 90 is slidable around the mast 32. An upper annular edge 92 of the sealing envelope is joined to a facing portion of the bottom panel 12 by zippers.

A decorative envelope 94 can be positioned around the mast 32 so as to extend from the ground 34 to the annular edge 92 of the sealing envelope 90. A top annular edge 96 of the decorative envelope 94 is joined to the bottom panel 12 again by way of zippers.

A centrifugal fan 98 is positioned on an inner peripheral portion of the bottom panel 12 as shown in FIG. 2. A flexible plastic intake tube 100 joins the centrifugal fan 98 to the outside by way of an opening defined in the peripheral belt 14.

Curtains 102 can also be provided all around the inflatable structure S as seen in FIG. 2. The curtains 102 can hang from a series of poles 104 which are secured under the peripheral belt 14 by way of loops hanging therefrom, as generally shown in FIG. 2. Preferably, ropes (not shown) are secured at one end thereof to the upper ends 62 of the poles 50, wherein the ropes are each attached at another end thereof to respective ones of the poles 104 so that the poles 104 hang therefrom. The series of poles 104 so mounted will thus define a polygonal outline under the peripheral belt 14.

Alternately, a rope can be wound under tension around all of the upper ends 62 of the poles 50, on succession, to form in a horizontal plane a polygon-shaped structure for hanging the curtains 102.

Figures 6, 7, 8:
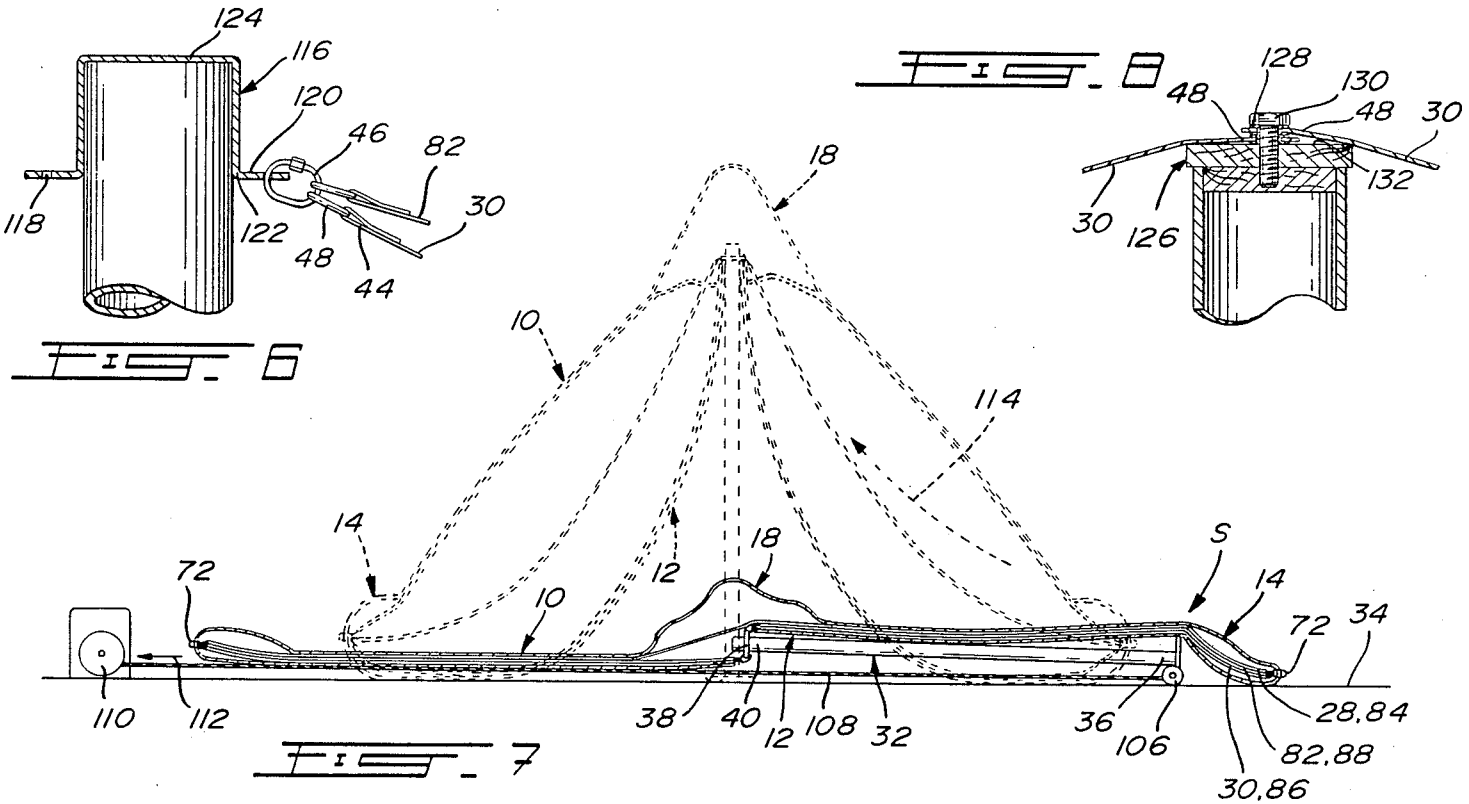
FIG. 6 is a cross-sectional elevation illustrating a further mode of attachment of the catenaries and shrouds to the upper end of the central mast.
FIG. 7 is a cross-sectional elevation showing a method of erection of the inflatable structure of FIG. 1, wherein the envelope thereof is initially on the ground and wherein, in dotted lines, the envelope is ready to be inflated to assume its inflated position illustrated in FIGS. 1 and 2.
FIG. 8 is a cross-sectional elevation illustrating a mode of attachment of the lower catenaries to the upper end of the central mast.

FIG. 7 illustrates a method for erecting the inflatable structure S illustrated in FIGS. 1 through 5. The inflatable structure S is first disposed on the ground 34 as shown in full lines. The top and bottom panels 10 and 12 are well displayed on the ground 34.

The sealing envelope is first slidingly engaged around the mast 32. The annular plate 38 can then be positioned on the top end 40 of the mast 36. All the connections to the central mast 32 by way of the quick links 46 are then made. The outward free ends 84, 86 and 88 of the upper and lower catenaries 28 and 30 and of the shrouds 82 are engaged in the quick links 72. At this point, the quick links 72 can also be engaged to the top ends 62 of the poles 50 which lie on the ground 34 and extend radially thereon outwards from the top plate 64 towards the anchor plate 54 thereof Also, at this point, the guy cables 76 can be joined to the top ends of the poles 50 by way of the quick links 74.

The bottom end 36 of the mast 32 is equipped with a wheel assembly 106. A strong cable 108 is secured at one end thereof to the wheel assembly 106 and at another end thereof to a motor driven winch 110.

Upon winding of the cable 108 by way of the winch 110, the bottom end 36 of the mast 38 is forcedly hauled towards the winch 110 in the direction indicated by arrow 112. The mast 32 then pivots about the wheel assembly 106 as indicated by arrow 114 until the mast 32 assumes a vertical position as indicated by the broken lines of FIG. 7. At that point, the top and bottom panels 10 and 12 hang in a flaccid fashion as shown again by the broken lines of FIG. 7.

Air is then introduced between the top and bottom panels 10 and 12 by way of the centrifugal fan 98 until the top and bottom panels 10 and 12, the peripheral belt 14, the dome 18 and the sealing envelope 90 assume their respective inflated positions of FIGS. 1 and 2. Then, the anchor plates 54 are secured to the ground 34, and the lower ends 52 of the poles 50 are secured to the anchor plates 54 so that the poles 50 assume a slightly inclined position, as best seen in FIG. 2. The guy cables 76 can then be secured to the ground 34 and tensioned using the aforementioned stakes.

In the inflated position, the catenaries 28 and 30 and the shrouds 82 are tensioned in directions generally opposite to that of the guy cables 76 at the plates 64 of the poles 50 to provide rigidity and stability to the inflated structure S. The upper and lower catenaries 28 and 30 provide some rigidity to the structure and prevent the top and bottom panels 10 and 12 respectively from over extending under the air pressure.

The optional decorative envelope 94 can then be positioned around the mast 32 and the wheel assembly 106 can be disassembled from the mast 32 while the winch 110 and cable 108 are removed from the site.

The centrifugal fan 98 will continuously provide air in the inflated structure as there are leaks therein such as between the lower part of the sealing envelope 90 and the mast 32, and on the periphery of the peripheral belt 14 at the locations where the quick links 72 extend therethrough.

The poles 104 and curtains 102 can then be positioned under the inflated structure S.

For safety purposes, a standby battery can be connected to the centrifugal fan 98 in case the standard electrical power source becomes disabled. For further safety, it is possible to have a back up centrifugal fan installed in the inflatable structure S. On the other hand, complete loss of air pressure inside the inflatable structure S will only result in the top panel 10 sagging and lying on the shrouds 82 or on the bottom panel 12 with the apex of the dome 18 possibly abutting the top end of the mast 32. The central mast 32 and the poles 50 along with the lower catenaries 30 which extend therebetween will provide ample support for the inflatable structure S. Even without some of the poles 50, the inflatable structure S will remain spaced from the ground 34 and therefore safe.

A filter or a screen can be mounted to the outside end of the flexible plastic tube 100.

In a further method of erection of the inflatable structure S, each pole 50 is mounted in respective sleeve 58 of the anchor plate 54 prior to the haulage and erection of the mast 32. The poles all substantially adopt the erected position thereof (as seen in FIGS. 1 and 2), thereby alleviating the load the mast 32 must lift during erection of the inflatable structure S.

On a further embodiment, the annular plate 38 and the pins 42 located on the top end 40 of the mast 32 can be replaced by a hat-shaped connector 116 which is removable from the top end 40 of the mast 32. As seen in FIG. 6, this connector 116, similarly to the annular plate 38, has openings 118 defined on the periphery of an annular flange 120 extending from a bottom edge 122 thereon. A top wall 124 of the connector 116 prevents the same from sliding downwards along the mast 32. Such a connector 116 is easily positioned on top of the mast 32 once all the lower catenaries 30 and shrouds 82 have been secured by way of the quick links 46 to the flange 120 thereof prior to proceeding with the erection of the inflatable structure S. The connector 116 has proven to be more efficient than the plate and pins 38 and 42.

The top and bottom panels 10 and 12, the peripheral belt 14, the dome 18, the sealing envelope 90 and the decorative envelope 94 can be made of a translucid material partly or on the whole surface thereof so that various lighting equipments can be mounted inside the inflatable structure S thereby providing a pleasant effect thereunder and in the vicinity thereof. Such lighting equipments can be, for example, fixed to the shrouds 82, to the top end 40 of the mast 32, to the top panel 10 and to loops hanging inside the belt 14.

It has been proven that the shrouds 82 are not necessary to ensure rigidity and stability of the inflatable structure S. Therefore, the shrouds 82 do not have any significant structural value. On the other hand, they are used for hanging lighting equipments. Consequently, it is easily understood that in a further inflatable structure embodying the present invention, such shrouds 82 could be eliminated.

In such a structure wherein no shrouds are used, the plate and pins 38 and 42 or the connector 116 can be simply replaced by a plug 126 made of wood which is fitted in the top end part 40 of the mast 32 (see FIG. 8). The inward ends 48 of the lower catenaries 30 are then each provided with a grommet 128. A nail or a bolt 130 is then used to secure all the inward ends 48 to cover a top surface 132 of the plug 126.

The stability and the rigidity of the inflatable structure S is ensured by a constant air pressure therethrough and by more or less rigid elements, such as the upper and lower catenaries 28 and 30, the mast 32 and the poles 50 along with the guy cables 76 attached thereto. A symmetry in all of these elements further ensures a stable and substantially rigid self-supporting structure. Stability of the inflatable structure S under great winds has also been proven.

Due to the symmetry of all the elements composing the inflatable structure S, the inflatable structure S is self adjusting whereby any excess load is equally distributed on all of the anchoring devices, meaning the arrangements of the poles 50 and the guy cables 76. Again, yielding of one or two of these anchoring devices, even of successive ones, does not affect the global safety and stability of the inflatable structure S.

The inside of the inflatable structure S is easily accessible whereby the lighting equipment is easily and safely mounted therein. Breakers are provided for the lighting equipment in case of air pressure losses.

From the foregoing, it is easily seen that such an inflatable structure S is of simple construction, easily and safely erected. Inflatable structure S can come in a variety of dimensions thereby accommodating such various applications as summer theatres, automobile dealerships, amusement parks, exhibitions, discotheques, fairs, flea markets, wedding receptions or the like.

I claim:

1. An inflatable structure comprising a double wall pneumatic envelope means including top and bottom panels; a central mast; a series of peripheral stabilizer means; a central portion of said bottom panel being adapted for mounting to a top end part of said mast, a bottom end part of said mast being adapted for stable contact with a ground surface, said stabilizer means being adapted for connection at upper and lower ends thereof respectively to peripheral portions of said envelope means and to the ground surface, whereby providing pneumatic pressure in said envelope means causes said double wall envelope means to inflate, said top panel being supported by the pneumatic pressure in an inflated position thereof, said peripheral portions of said envelope means being supported in a spaced apart relationship with respect to the ground surface by the pneumatic pressure and by said stabilizer means, tension being provided to said envelope means by said stabilizer means acting against a natural tendency of the envelope means to contract in a substantially horizontal plane while expanding vertically at the center thereof when submitted to pneumatic pressure, said envelope means assuming a tent-like structure.

2. An inflatable structure as defined in claim 1, wherein said envelope means further comprises a pneumatic peripheral belt, said belt having a C-shaped vertical cross-section, said top and bottom panels being separate panels having peripheral edges thereof adapted for connection in a spaced apart relationship respectively to upper and lower inner free edges of said peripheral belt, a convex portion of said belt extending outwards of said peripheral edges, whereby the pneumatic pressure acts in said belt.

3. An inflatable structure as defined in claim 2, wherein said top and bottom panels and said peripheral belt are each made of flexible air impervious material, said top and bottom panels being made up of radially extending strips connected edge to edge with adjacent strips.

4. An inflatable structure as defined in claim 3, wherein said flexible air impervious material is a polyester fabric having a PVC coating, and wherein said strips are connected one to the other by microwave welds and by seams, said peripheral belt being connected similarly to said top and bottom panels.

5. An inflatable structure as defined in claim 3, wherein said top panel comprises a series of upper catenaries extending therein radially from a top portion thereof past said peripheral edge thereof and close to said convex portion of said peripheral belt, said bottom panel comprising a series of lower catenaries extending therein radially from an inner portion thereof past said peripheral edge thereof and close to said convex portion, connection means being provided for connecting outward free ends of both said upper and lower catenaries to respective ones of said upper ends of said stabilizer means, said lower catenaries having inward free ends adapted for connection to said top end part of said mast, whereby said upper and lower catenaries allow said top and bottom panels respectively to extend under the pneumatic pressure in generally opposite directions in substantially uniform generally parabolic arch shapes and prevent said panels from over extending, said lower catenaries further providing support for said bottom panel when said envelope means is inflated.

6. An inflatable structure as defined in claim 5, wherein said envelope means further comprises a series of shrouds each being provided for connection at opposed free ends thereof to said top end part of said mast and to respective ones of said upper ends of said stabilizer means, said shrouds extending radially in said envelope means intermediate said top and bottom panels, whereby said shrouds provide stability to said envelope means when inflated.

7. An inflatable structure as defined in claim 6, wherein an annular steel plate is provided for mounting at said top end part of said mast, said annular plate having a series of openings defined therethrough along a periphery thereof, first link means being provided for engagement in said openings for connection thereto and to inner free ends of paired up lower catenaries and shrouds, thereby providing means for connecting said inner free ends to said top end part of said mast.

8. An inflatable structure as defined in claim 6, wherein a hat-shaped connector means is provided for mounting at said top end part of said mast, a sleeve part of said connector means being slidable around said top end part of said mast, a top wall of said connector means being adapted for abutting a top annular edge of said mast, an annular flange of said connector means extending radially outwards from a lower edge thereof and comprising a series of openings defined therethrough along a periphery thereof, first link means being provided for engagement in said openings for connection thereto and to inner free ends of paired up lower catenaries and shrouds thereby providing means for connecting said inner free ends to said top end part of said mast.

9. An inflatable structure as defined in claim 8, wherein each one of said shrouds has an outward free end extending close to said convex portion of said belt, an opening being defined in each one of said upper ends of said stabilizer means, said outward free ends of said upper and lower catenaries and of said shrouds being joined three by three for connection to a respective opening of said upper ends of said stabilizer means by way of a second link means extending through said convex portion of said belt, said second link means being engaged in said opening and in loops provided at said outward free end.

10. An inflatable structure as defined in claim 9, wherein said stabilizer means each comprise a pole having a connection plate mounted transversely at an upper end thereof, said opening being defined in said connection plate opposite a further opening defined therein; an anchor plate having holes defined therein and a sleeve extending upwards substantially from a central portion of a top surface thereof, a first pair of diametrically opposed apertures being defined through sidewalls of a lower end of said pole; a second pair of diametrically opposed apertures being defined through sidewalls of said sleeve; a guy cable and a stake; wherein said anchor plate is secured to the ground surface by nail means planted therein through said holes thereof, said lower end of said pole being mounted to said anchor plate by sliding engagement thereof in said sleeve with said first and second pairs of apertures being aligned for introducing a pin means therethrough thereby securing said pole to said anchor plate; an upper end of said guy cable being adapted for connection by way of a third link means to said further opening, a lower end of said guy cable being adapted for connection to the ground surface by way of said stake.

11. An inflatable structure as defined in claim 10, wherein said pole extends at an acute angle from the vertical inwardly towards said mast from said upper end of said pole to said lower end thereof, and wherein said guy cable extends at an oblique angle from the vertical away from said mast from said upper end of said guy cable to said lower end thereof, whereby said pole and said guy cable provide tension to respective ones of said upper and lower catenaries and shrouds, the peripheral distribution of said series of stabilizer means providing a peripheral uniform tensioning of said envelope means, thereby providing stability thereto.

12. An inflatable structure as defined in claim 1, wherein the pneumatic pressure is provided by a centrifugal fan adapted to be mounted within said envelope means on an inner peripheral surface of said lower panel, a flexible air intake tube extending from said fan to the outside through an opening defined in said envelope means.

13. An inflatable structure as defined in claim 3, wherein a sealing pneumatic envelope is provided for providing sealing to said envelope means at said central portion cf said bottom panel, said sealing envelope having a truncated cone shape, a narrow annular free edge thereof being slidable around said mast, whereby said sealing envelope is positioned around said mast with said narrow free edge thereof being positioned lower than a large annular free edge thereof, said large free edge being adapted for connection to an underside of said central portion of said bottom panel, said sealing envelope being made of a same material as said upper and lower panels.

14. An inflatable structure as defined in claim 13, wherein said large free edge of said sealing envelope is connected to said central portion of said bottom panel by zipper means.

15. An inflatable structure as defined in claim 2, wherein a series of loops are fixed all along an underside of said belt, poles being adapted to be mounted substantially horizontally through said loops for providing means for hanging curtains under said envelope means.

16. An inflatable structure as defined in claim 1, wherein a series of rope means are adapted for connection at first ends thereof to said upper ends of said stabilizer means and at second ends thereof to substantially horizontally disposed poles in a spaced apart relationship with respect to the ground surface, thereby providing means for hanging curtains under said envelope means.

17. An inflatable structure as defined in claim 16, wherein facing ends of successive ones of said poles are both secured to a respective one of said second ends of said rope means.

18. An inflatable structure as defined in claim 3, wherein means are provided in inflatable sections of said inflatable structure for mounting lighting means therein at select predetermined positions.

19. An inflatable structure as defined in claim 18, wherein at least part of said lighting means are adapted to be mounted to said shrouds, said top end part of said mast and to an inner top wall of said belt.

20. An inflatable structure as defined in claim 8, wherein said first, second and third link means are quick links.

21. An inflatable structure as defined in claim 6, wherein a plug-shaped connector means is provided for mounting at said top end part of said mast, said connector means comprising first and second short cylindrical sections secured together, said first section being as large as an outside diameter of said mast, said second section being slidable in said mast, said inner free ends of said lower catenaries and of said shrouds each comprising a grommet means, said inner free ends are bolted through said grommet means thereof on top of said first section of said connector means.

22. An inflatable structure as defined in claim 1, wherein a rope means is wound under tension around all of said upper ends of said series of stablilizer means thereby defining a horizontal hanging means of polygonal outline adapted for hanging curtains therefrom.

* * * * *